US005391090A

United States Patent [19]

Power

[11] Patent Number: 5,391,090

[45] Date of Patent: Feb. 21, 1995

[54] LOCKING MECHANISM FOR CONNECTORS

[75] Inventor: Michael M. Power, Shizuoka, Japan

[73] Assignee: Yazaki Corporation, Tokyo, Japan

[21] Appl. No.: 96,493

[22] Filed: Jul. 26, 1993

[30] Foreign Application Priority Data

Jul. 29, 1992 [JP] Japan ..... 4-202268

[51] Int. Cl.[6] ..... H01R 13/627

[52] U.S. Cl. ..... 439/354; 439/353

[58] Field of Search ..... 439/350, 351, 352, 353, 439/354, 355, 356, 357, 358

[56] References Cited

U.S. PATENT DOCUMENTS

| | | | |
|---|---|---|---|
| 4,582,378 | 4/1986 | Fruchard | 439/350 |
| 4,655,527 | 4/1987 | Vandame | 439/350 |
| 4,884,978 | 12/1989 | Inaba et al. | 439/350 |
| 4,900,263 | 2/1990 | Manassero et al. | 439/358 |
| 5,015,199 | 5/1991 | Hirano et al. | 439/353 |

*Primary Examiner*—Larry I. Schwartz
*Assistant Examiner*—Hien D. Vu
*Attorney, Agent, or Firm*—Armstrong, Westerman, Hattori, McLeland & Naughton

[57] ABSTRACT

A locking mechanism for connectors that permits easy unlocking of the mating connector housings comprising: a resilient locking arm and resilient auxiliary locking pieces, both provided at one of mating connector housings; locking projections provided at the locking arm, the locking projections including: a tapered engagement guide surface sloping upwardly from the front toward the rear and a lock-engagement surface at the rear end of the locking projections; engagement projections provided at the auxiliary locking pieces with longitudinally extending tapered guide surfaces; an engagement frame provided at the other connector housing to receive the advancing locking arm and auxiliary locking pieces, the engagement frame including lock-engagement projections to engage with the locking projections and engagement portions for engaging with the engagement projections; and an unlocking operation portion provided at the locking arm of the first connector housing, the unlocking operation portions projecting from the engagement frame of the second connector housing when the connector housings are engaged.

6 Claims, 4 Drawing Sheets

LOCKING MECHANISM FOR CONNECTORS

BACKGROUND OF THE INVENTION

1. Field of the Invention

The present invention relates to a locking mechanism for connectors used to connect wiring harness in automobiles.

2. Description of the Prior Art

FIG. 4 shows a perspective view of a conventional connector disclosed by U.S. Pat. No. 4,900,263. The figure illustrates a male connector housing a with terminal accommodating chambers b and a female connector housing c with terminal accommodating chambers d. Both connector housings accommodate in their terminal accommodating chambers b and d a pair of terminal tabs for connection with each other in a known manner.

The male connector housing a has a locking projection e in the form of a pentagonal pillar on the top surface of the male connector housing. The female connector housing c has on its top surface a pair of cantilever locking arms g with hook-shaped lock-engagement portions f arranged to face each other at their front ends.

When the male and female connector housings a and c are connected together, the front ends of the lock-engagement portions f abut against tapered guide surfaces $e_1$ on the locking projection e, causing the pair of locking arms g to separate and open outwardly to the left and right. While the locking arms g are open, the locking projection e passes through the lock-engagement portions f, which snap back to their original shapes to engage with the lock-engagement surfaces $e_2$ from the rear (see FIG. 5).

To unlock the housings, as shown in FIG. 6, a tool such as screwdriver is inserted between a front tapered portion h of the lock-engagement portion f and the male connector housing a to displace the lock-engagement portion f upward and thereby disengage the locking projection e.

This method, however, may result in damage to the locking arms g or permanent deformation.

SUMMARY OF THE INVENTION

The present invention has been accomplished with the objective of overcoming the above drawback and aims to provide a locking mechanism for connectors which facilitates unlocking of the housing while preventing inadvertent unlocking.

To achieve the above objective, the locking mechanism for connectors according to this invention comprises:

- a resilient locking arm and resilient auxiliary locking pieces, both provided at one of mating connector housings;
- locking projections provided at the locking arm with:
  - a tapered engagement guide surface sloping upwardly from the front toward the rear; and
  - a lock-engagement surface at the rear end of the locking projections;
- engagement projections provided at the auxiliary locking pieces with longitudinally extending tapered guide surfaces;
- an engagement frame provided at the other connector housing to receive the advancing locking arm and auxiliary locking pieces, the engagement frame including lock-engagement portions to engage the locking projections and engagement portions to engage the engagement projections; and
- an unlocking operation portion provided at the locking arm of the first connector housing, the unlocking operation portions projecting from the engagement frame of the second connector housing when the connector housings are engaged.

As the pair of connector housings are disengaged by depressing the unlocking operation portion to disengage the locking arm and the lock-engagement portions, the auxiliary locking pieces of one connector housing are automatically displaced by the tapered guide surfaces of the engagement projections sliding in contact with the engagement portions of the engagement frame of the other connector housing.

DETAILED DESCRIPTION OF PREFERRED EMBODIMENT

Figure 1:
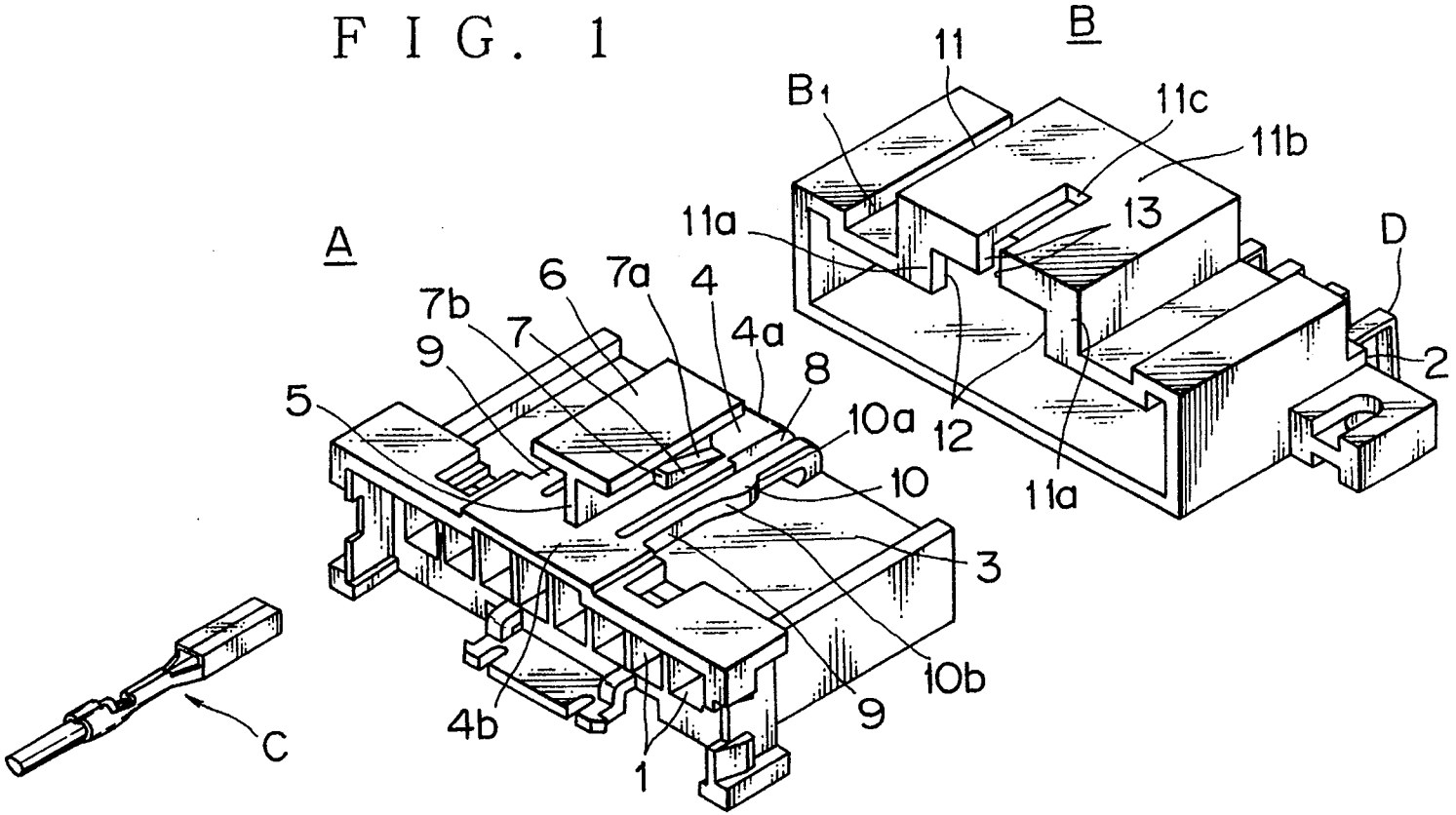
FIG. 1 is a perspective view showing a pair of connector housings of one embodiment in a disconnected condition.

A male connector housing A and a female connector housing B are each fabricated from a single piece of synthetic resin. The male connector housing A accommodates female connector terminal lugs C in its terminal accommodating chambers 1. Male terminal lugs D are secured at a rear wall 2 of the female connector housing. B and project into a housing body $B_1$.

A resilient locking arm 4 extending longitudinally with a front support portion 4*a* and a rear support portion 4*b* is located on a top wall 3 of the male connector housing A. A longitudinally extending upright wall 5 is provided at the intermediate portion on the locking arm 4. At the upper end of the upright wall is a plate-like unlocking operation portion 6 projecting horizontally to left and right and formed integrally with the upright wall 5. Locking projections 7 are formed on the locking arm 4 on both sides of the upright wall 5 with a tapered engagement guide surface 7*a* that slopes upwardly from the front toward the rear and a lock-engagement surface 7*b* at the rear end. Both sides of the locking arm 4 are formed with slits 8 that extend from the front end into the intermediate portion of the locking arm 4 to form resilient auxiliary locking pieces 9 supported on both ends like a simple beam. Each auxiliary locking piece 9 has an engagement projection 10 bulging outwardly from the side which has tapered guide surfaces 10*a*, 10*b* extending longitudinally.

A lock-engagement frame 11 is formed on the top of the housing body $B_1$ of the female connector housing B. This lock engagement frame connects with the interior of the housing body $B_1$ and has a pair of vertical walls 11*a*. It also has engagement portions 12 at the inner sides of the facing upright walls 11*a* and, at the intermediate portion of the top wall 11*b*, a longitudinally extending slit 11*c* that has lock-engagement projections 13 on both sides at the front of the top wall 11*b*.

Figure 2A:
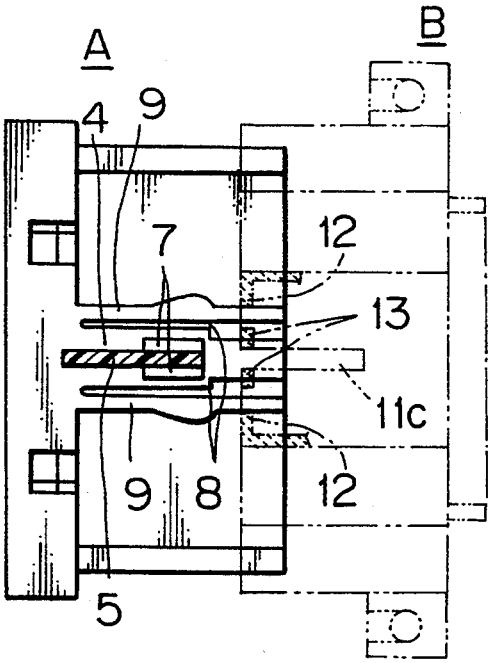
FIG. 2A through 2D are partly cutaway plan views showing the process of connecting the pair of connectors.
Figure 2B:
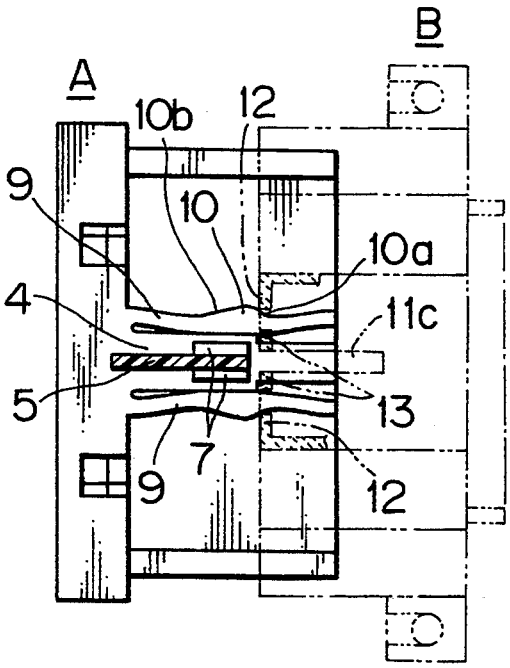
Figure 2C:
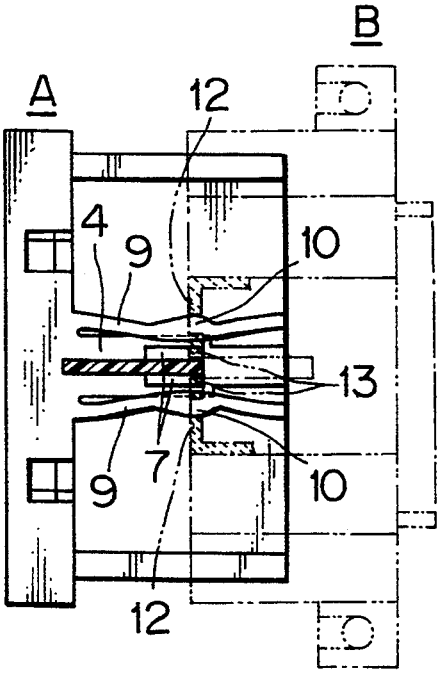
Figure 2D:
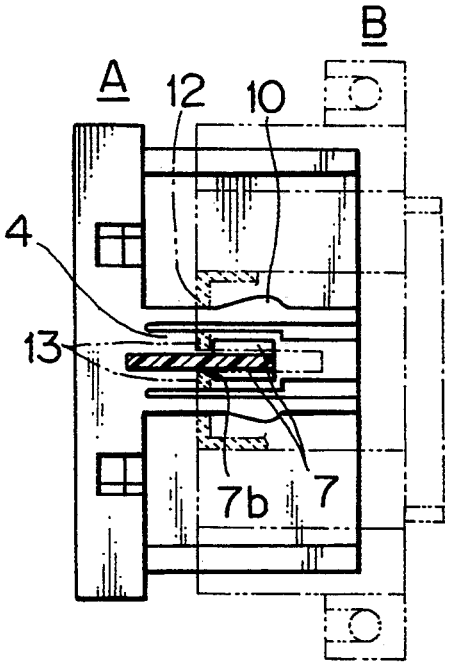
Figure 3:
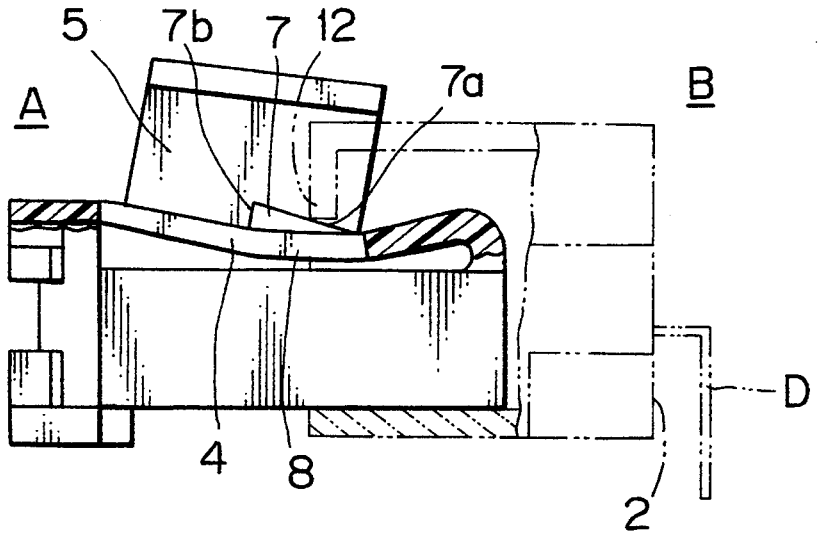
FIG. 3 is a side view of a locking mechanism during the above connecting process.
Figure 4:
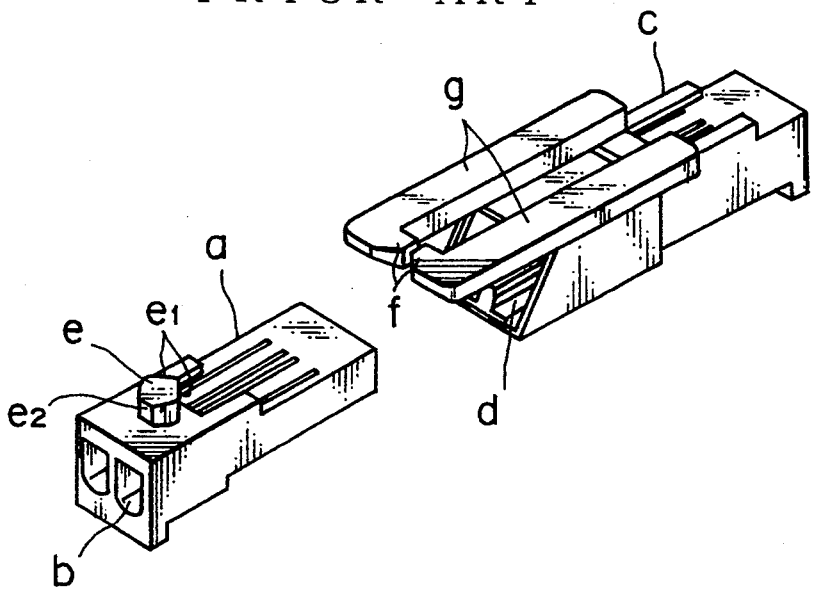
FIG. 4 PRIOR ART
FIG. 4 is a perspective view of conventional connector housings.
Figure 5:
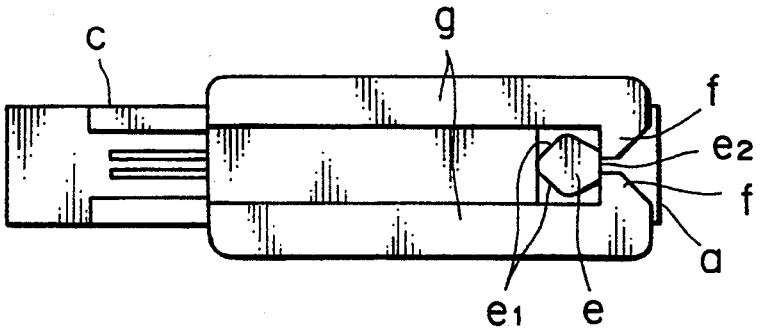
FIG. 5 PRIOR ART
FIG. 5 is a plan view showing the pair of conventional connector housings connected together.
Figure 6:
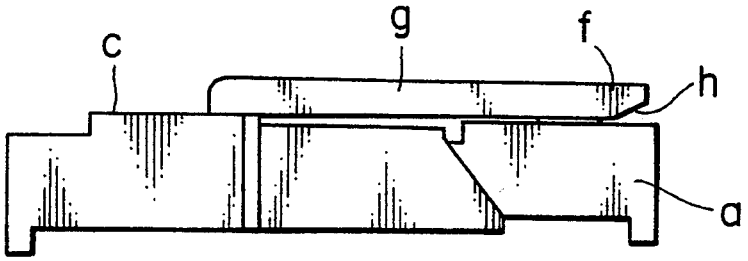
FIG. 6 PRIOR ART
FIG. 6 is a side view showing the same of FIG. 5 in the connected condition.

In this construction, as the female and male connector housings A and B are engaged, the locking arm 4 and the auxiliary locking pieces 9 advance into the lock-engagement frame 11 (see FIG. 2A). Then, the tapered guide surface 10*a* of the engagement projection 10 comes into contact with the engagement portion 12 and causes the auxiliary locking pieces 9 to be displaced inwardly through the slits 8 and pressed against the sides of the locking arm 4 (see FIG. 2B). As the locking arm 4 further advances, the bulged portion of the engagement projection 10 makes contact with the engagement portion 12 of the frame 11 so that the auxiliary locking pieces 9 are deflected to the maximum extent. At the same time, the tapered engagement guide surfaces 7*a* of the locking projections 7 engage the lock-engagement projections 13, which ride over the locking arm 4 (see FIG. 2C). As the housings are further pushed closer together, the upright wall 5 advances deep into the slit 11*c*, with the unlocking operation portion 6 situated on the top wall 11*b* and the tapered guide surfaces 10*b* of the engagement projections 10 slide into contact with the engagement portions 12 allowing the auxiliary locking pieces 9 to move outwardly to recover their original shape. The tapered engagement guide surfaces 7*a* of the locking projections 7 further slide while in contact with the lock-engagement projections 13, and the locking arm 4 is deflected downward toward the top wall 3 (see FIG. 3). When the locking projections 7 have moved past the lock-engagement projections 13, the locking arm 4 snaps back to its original shape causing the lock-engagement surfaces 7*b* at the rear end to engage the lock-engagement projections 13 (see FIG. 2D).

To disconnect the male and female connector housings A and B, the unlocking operation portion 6 is depressed to deflect the locking arm 4 downward and thereby disengage the locking projections 7 from the lock-engagement projections 13. The male and female connector housings A and B are then pulled apart while the auxiliary locking pieces 9 are deflected so that the male and female connector housings A and B are disengaged.

Even when the unlocking operation portion 6 is accidentally depressed by external force, disengaging the locking projections 7 and the lock-engagement projections 13, the auxiliary locking pieces 9 resist the disengaging motion of the male and female connector housings A and B, thus preventing undesired unlocking.

As described above, the locking mechanism of this invention comprises: a resilient locking arm and resilient auxiliary locking pieces, both provided at one of mating connector housings; locking projections provided at the locking arm with a tapered engagement guide surface sloping upwardly from the front toward the rear and a lock-engagement surface at the rear end of the locking projections; engagement projections provided to the auxiliary locking pieces with longitudinally extending tapered guide surfaces; an engagement frame provided to the other connector housing to receive the advancing locking arm and auxiliary locking pieces, the engagement frame with lock-engagement projections to engage the locking projections and engagement portions for engaging with the engagement projections; and an unlocking operation portion provided at the locking arm of the first connector housing, the unlocking operation portion projecting from the engagement frame of the second connector housing when the connector housings are engaged.

This construction facilitates the unlocking operation and also prevents unwanted accidental unlocking of the connector housings by the resisting action of the auxiliary locking pieces.

What is claimed is:

1. A locking mechanism for connectors comprising:

a resilient locking arm and resilient auxiliary locking pieces, both provided at a first connector housing;

locking projections provided at the locking arm, the locking projections including:

a tapered engagement guide surface sloping upwardly from the front toward the rear; and a lock-engagement surface at the rear end of the locking projections;

engagement projections provided at the auxiliary locking pieces with longitudinally extending tapered guide surfaces;

an engagement frame provided at a second connector housing to receive the locking arm and auxiliary locking pieces, the engagement frame including lock-engagement projections to engage the locking projections of the locking arm of the first connector housing, and engagement portions for engaging with the engagement projections of the locking pieces of the first connector housing; and an unlocking portion extending from the top of the locking arm of the first connector housing, the unlocking portion projecting upwardly from the engagement frame of the second connector housing when the connector housings are engaged.

2. A locking mechanism for connectors as claimed in claim 1, wherein said resilient auxiliary locking pieces deflect in a direction perpendicular to a direction that the resilient locking arm deflects.

3. A locking mechanism for connectors as claimed in claim 1, wherein said unlocking portion comprises a pressing piece which extends through and above said second connector housing for allowing pressing and disconnection of said first and second connector housings.

4. A locking mechanism for connectors as claimed in claim 3, wherein said pressing piece comprises a vertically extending portion which extends through said second connector housing, and a horizontally extending portion for pressing, such that said pressing piece has a T-shape cross section.

5. A locking mechanism for connectors as claimed in claim 1, wherein said resilient auxiliary locking pieces are horizontally extending elongated pieces which extend in parallel to said resilient locking arm, said resilient locking arm movable in a vertical direction and said elongated pieces movable in a horizontal direction toward and away from said resilient locking arm.

6. A locking mechanism for connectors as claimed in claim 2, wherein said resilient auxiliary locking pieces are pressed by said second connector housing when said first connector housing is withdrawn from said second connector housing so as to avoid accidental disengagement of said first and second connector housings when said resilient locking arm is accidentally deflected.

* * * * *